US007381104B2

(12) United States Patent
Rehbein et al.

(10) Patent No.: US 7,381,104 B2
(45) Date of Patent: Jun. 3, 2008

(54) ELECTRIC PLUG-IN CONNECTOR HAVING A PRESTRESSED CONTACT LAMINA

(75) Inventors: Peter Rehbein, Weissach (DE); Andreas Simmel, Schwaikheim (DE); Eckhardt Philipp, Schwieberdingen (DE)

(73) Assignee: Robert Bosch GmbH, Stuttgart (DE)

( * ) Notice: Subject to any disclaimer, the term of this patent is extended or adjusted under 35 U.S.C. 154(b) by 0 days.

(21) Appl. No.: 11/711,573

(22) Filed: Feb. 26, 2007

(65) Prior Publication Data

US 2007/0218763 A1 Sep. 20, 2007

(30) Foreign Application Priority Data

Feb. 28, 2006 (DE) ..... 10 2006 009 074

(51) Int. Cl.
*H01R 13/11* (2006.01)

(52) U.S. Cl. ..... 439/852

(58) Field of Classification Search ..... 439/852, 439/851, 853, 854

See application file for complete search history.

(56) References Cited

U.S. PATENT DOCUMENTS 6,524,142 B2 * 2/2003 Heimueller ..... 439/852
6,971,927 B2 * 12/2005 Anbo et al. ..... 439/852
7,204,728 B2 * 4/2007 Noro et al. ..... 439/852
7,252,561 B2 * 8/2007 Nora et al. ..... 439/852
2001/0002350 A1 * 5/2001 Kashiyama et al. ..... 439/848
2005/0153605 A1 * 7/2005 Anbo et al. ..... 439/852
2006/0172621 A1 * 8/2006 Noro et al. ..... 439/852
2007/0134996 A1 * 6/2007 Ellis ..... 439/852

* cited by examiner

*Primary Examiner*—Gary F. Paumen
(74) *Attorney, Agent, or Firm*—Kenyon & Kenyon LLP

(57) ABSTRACT

An electric plug-in connector includes a plug receptacle provided for insertion of a contact pin, a contact lamina pivotally mounted on the plug-in connector housing, its free end being directed in the insertion direction of the contact pin, and a holding arm pivotably mounted on the plug-in connector housing, which protrudes at its free end into the plug receptacle in the ready-to-insert starting state of the plug-in connector and also holds back the contact lamina that is prestressed into the plug receptacle, the contact lamina and/or the opposite housing wall being made of an electrically conducting material for contacting the inserted contact pins.

9 Claims, 3 Drawing Sheets

ELECTRIC PLUG-IN CONNECTOR HAVING A PRESTRESSED CONTACT LAMINA

FIELD OF THE INVENTION

The present invention is directed to an electric plug-in connector having a plug receptacle provided for insertion of a contact pin.

BACKGROUND INFORMATION

Currently in the automotive field there are known electric plug-in connectors having contact laminae, in a prestressed state ready for plug-in connection to a contact pin. Prestressing is achieved by intentionally bending the contact laminae back from an initially bent-over state and supporting them in this new position by rigid supports on a steel nib. Due to this prestressing of the contact laminae, a large contact gap should be established without reducing the operative normal contact forces in the plug-in state, these forces being defined by the prebending state of the contact laminae in the unloaded state. The advantage of a large contact gap established in this way is that the high frictional force at the start of the plug-in operation (opening-up peak in the contact force-path diagram) is greatly reduced because the contact laminae and the contact pin do not come in contact with one another until immediately before the parallel region of the contact pin, i.e., in an area in which the sliding angles relative to the frictional forces are favorable. In addition, the probability of underplugging of the contact laminae is reduced by a large contact gap.

With the known electric plug-in connectors having prestressed contact laminae, the abutments for the prestressing are rigid elements of the steel nib which limit the spring movement of the contact laminae at one side even in the plugged-in state. Owing to the narrow tolerances of such spring systems, there is the risk that the contact force will not be reached completely and/or the contact pin will be contacted on only one side.

SUMMARY OF THE INVENTION

The electric plug-in connector according to the present invention has the advantage over the related art that the normal contact force becomes operative only when the contact pin has already been inserted into the plug receptacle far beyond the contact points. This avoids the so-called opening-up peak during the plug-in operation so that the plug-in force required to establish a plug-in connection can be greatly reduced. For the case when the contact pin is not inserted any further, as soon as it has released the holding arm in the initial insertion, the resistance force experienced by the contact pin during its insertion phase results but only from the deformation force and the low frictional force required to release the holding mechanism of the contact lamina. Through the precise design of the geometry of the lever and catch, this resistance force may be reduced to a level below the level of the sliding friction that would occur in the case when the contact pin is pushed further, in which case the contact lamina thereby released would press with a fully operative normal contact force in the contact points onto the contact pin surface. In both cases, however, the so-called opening-up peak is avoided in the initial insertion, this peak being significantly above the level of the sliding friction and therefore determining to a significant extent the total variation of the plug-in force of known plug-in connections.

The contact lamina, attached in particular in the mouth area of the electric plug-in connector, protrudes into the plug receptacle, and is held in a pressed position by the deflectable holding arm, in such a way that the incoming pin of the mating connector can be pushed without force between the contact points of the plug receptacle. At the end of an insertion path, the incoming contact pin presses with a low force against the deflectable holding arm in such a way that the latter is pivoted and releases the prestressed contact lamina. The contact lamina in turn establishes the frictional connection via the contact points and preferably also establishes an electrical connection with the contact pin. The contact lamina is preferably made of spring steel and is gold-plated in the area of its contact point.

The deflectable holding arm may be punched from the plug-in connector housing, for example, and pushed inward. However, the holding mechanism is activatable only during the initial insertion. Once the holding mechanism has been released for the first time by the incoming contact pin, it is not necessary (and presumably it is also impossible) for the holding arm to resume its original position and hold the contact lamina again in the prestressed state. When a second insertion is required, the spring path of the contact lamina may be limited with protrusions running laterally in recesses. However, an increased frictional resistance must be assumed in a second insertion because the opening-up peak mentioned above is then also no longer preventable.

The present invention makes it possible to significantly reduce the required plug-in force of an electric plug-in connector in the initial insertion and thus the design of the plug-in connector may be simpler and less expensive. The electric plug-in connector according to the present invention is able to:

- reduce the opening-up peak during the initial plug-in insertion procedure to below the level of the sliding friction forces in the plateau region of the plug force-path curve due to the very precise type of adjustment of the prestress;
- be implemented in contact systems in which the front contact area is vibration ally separated from the crimp area and steel nib because interactions with the surrounding elements of the contact are not necessary in this system;
- be manufactured within very narrow tolerances because these are exclusively punching-bending processes of one part and the precision of the punching process defines the size of the gap at this point.

DETAILED DESCRIPTION

Figure 1A:
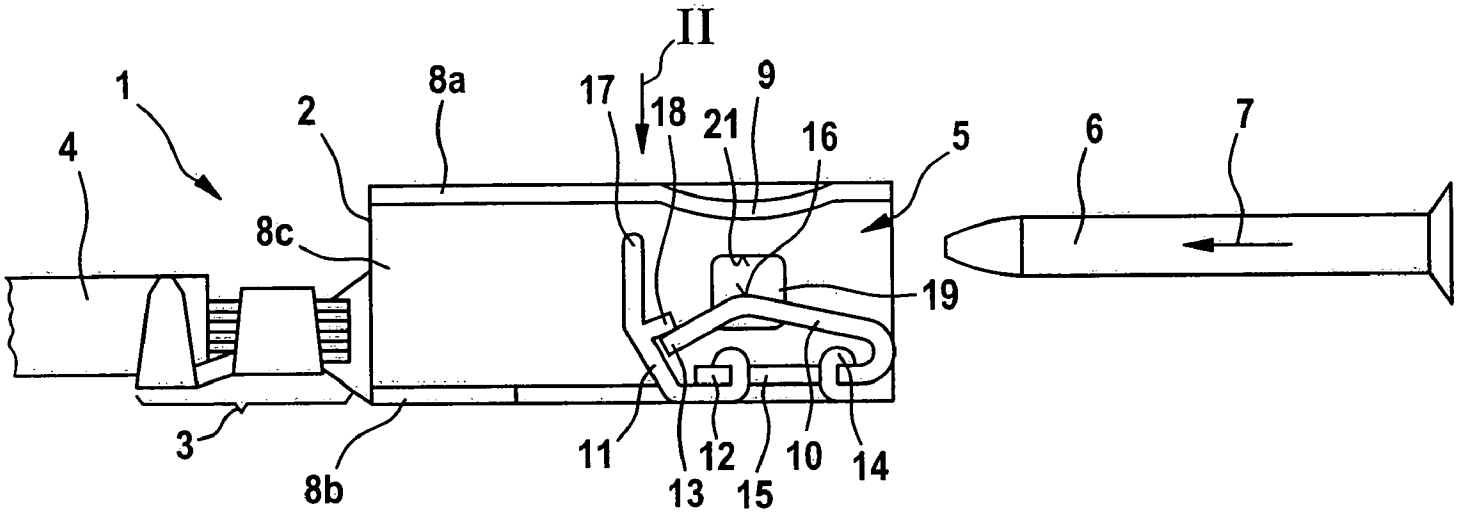
FIGS. 1*a* and 1*b* show the electric plug-in connector according to the present invention in the starting state (FIG. 1*a*) ready for the initial plug-in insertion and in the final plugged-in state (FIG. 1*b*).

Electric plug-in connector 1 shown in FIG. 1*a* includes a plug-in connector housing 2 manufactured from an electrically conducting material, e.g. sheet metal (copper), and by punching and bending. At one end, plug-in connector housing 2 is connected by a crimp area 3 to an electric connecting cable 4, and at the other end it has a plug receptacle 5 into which an electrically conducting contact pin 6 is to be inserted in insertion direction 7.

Plug receptacle 5 is formed by four side walls 8*a*-8*d* of plug-in connector housing 2, upper side wall 8*a* in FIG. 1*a* having a contact point 9 which is gold-plated on the inside and curved toward the inside into plug receptacle 5. A contact lamina 10 and a holding arm 11 are pivotally mounted on lower side wall 8*b* in FIG. 1*a*. Contact lamina 10 is formed by one leg of a U-shaped sheet metal part (e.g., made of spring steel), other leg 12 being attached to lower side wall 8*b*. Contact lamina 10 extends with its free end 13 in insertion direction 7 inside plug receptacle 5. Leg 12 of the U-shaped sheet metal part is attached to lower side wall 8*b* by two straps 14 of lower side wall 7*b* that are bent over inward, reaching through a recess 15 to grip and clamp leg 12 and also establish electric contact. On its inside protruding into plug receptacle 5, contact lamina 10 has a gold-plated contact point 16. Holding arm 11 is formed by a strap punched out accordingly and extending in insertion direction 7 from lower side wall 8*b* and is bent into plug receptacle 5 at its free end 17.

Figure 1B:
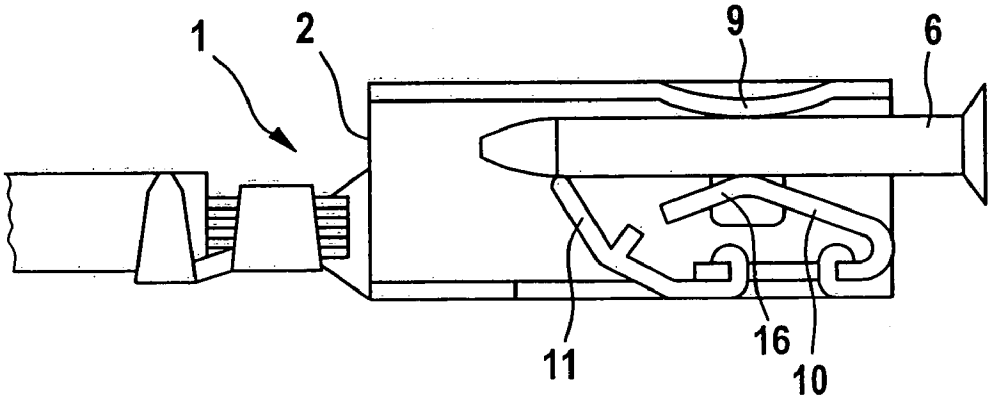

FIG. 1*a* shows electric plug-in connector 1 in its starting state ready for initial insertion; in this state, contact lamina 10 prestressed into plug receptacle 5 is held back by a protrusion (catch nose) 18 on holding arm 11, and holding arm 11 protrudes at its free end 17 further into plug receptacle 5 than does contact lamina 10. To form an electric plug-in connection, contact pin 6 is pushed between two contact points 9, 16 without applying force until it presses with a low force against free end 17 of holding arm 11 at the end of its insertion path, deflecting the holding arm in insertion direction 7. Because of its prestress, contact lamina 10, which is thereby released, pivots into contact with contact pin 6, which is thereby held with a clamping effect between two contact points 9, 16, establishing an electrical connection. In other words, contact lamina 10 establishes the frictional connection via contact points 9, 16 and the electrical connection with contact pin 6. FIG. 1*b* shows electric plug-in connector 1 in its end state with contact pin 6 fully inserted.

For the case when contact pin 6 is not inserted further as soon as it has released holding arm 11 in the initial insertion, this results in the resistance force which contact pin 6 experiences during its insertion phase, but only from the deformation force and the low frictional force that is required to release the holding mechanism of contact lamina 10. Due to the accurate design of the geometry of the lever and catch, this resistance force is reducible to a level below that of the sliding friction which would occur in the case when contact pin 6 is pushed further, in which case contact lamina 10 thereby released would press against the contact pin surface in contact points 9, 16 with the fully operative normal contact force. In both cases, however, this avoids the opening-up peak on initial insertion, which is significantly above the level of the sliding friction and therefore determines to a significant extent the total plug-in force curve of known plug-in connections.

Figure 2:
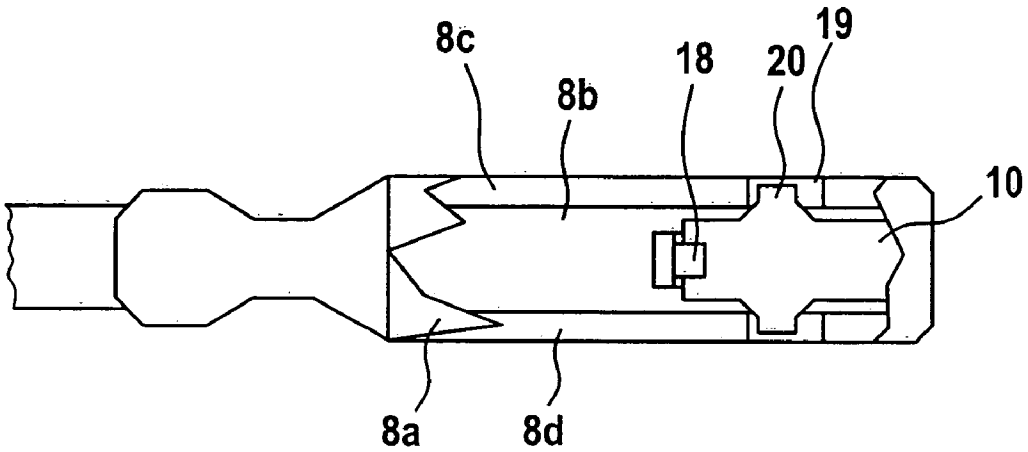
FIG. 2 shows the electric plug-in connector in a partially exploded view according to II in FIG. 1*a*.

Once the holding mechanism has been released by incoming contact pin 6, it is not necessary (and is presumably also not possible) for holding arm 11 to resume its original position and hold contact lamina 10 again in the prestressed state. For the case when a second insertion is required, the spring path of contact lamina 10 is limited by protrusions 20 running laterally in recesses 19 of side walls 8*c*, 8*d* as shown in FIG. 2, i.e., edge 21 of recess 19 forms a stop which limits the pivoting movement of spring arm 5 into plug receptacle 3.

Figure 3A:
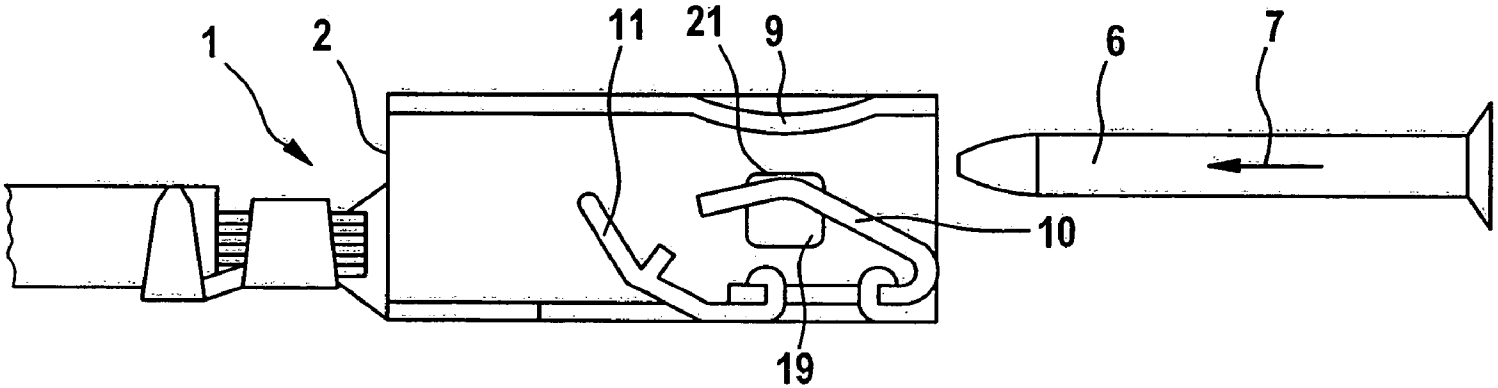
FIGS. 3*a* and 3*b* show the electric plug-in connector from FIG. 1 in the starting state (FIG. 3*a*) ready for a second plug-in insertion and in the final plugged-in state (FIG. 3*b*).
Figure 3B:
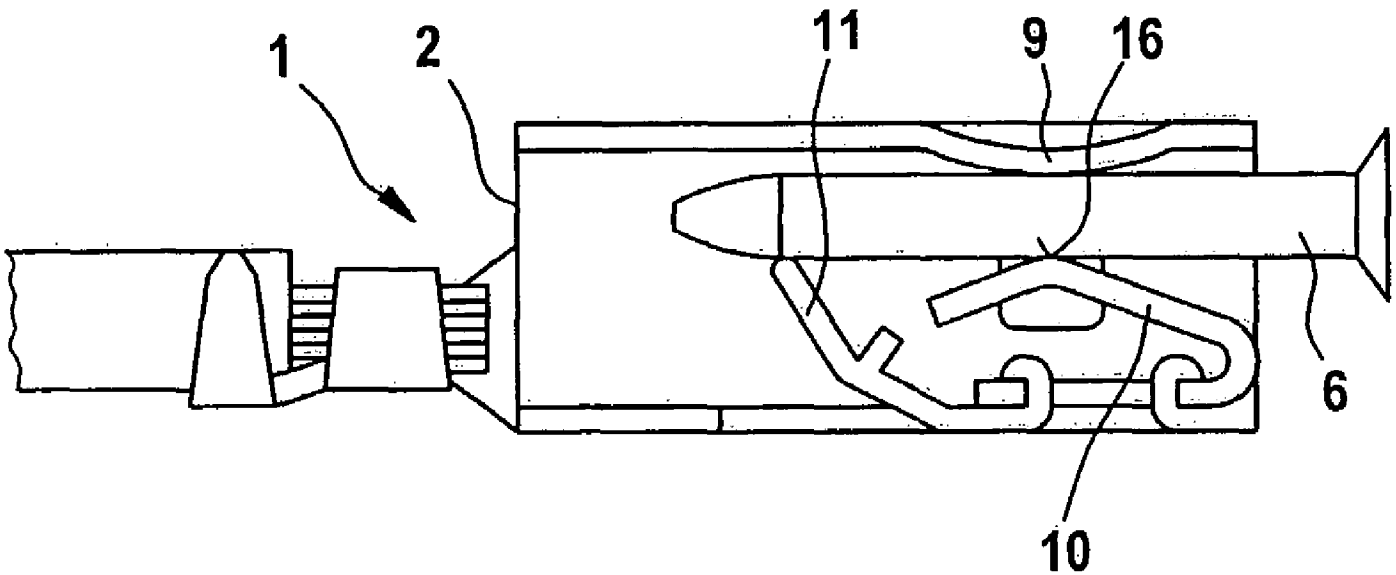

FIG. 3*a* shows electric plug-in connector 1 in its starting state ready for a second insertion, in which state contact lamina 10, prestressed into plug receptacle 5, is in contact at its protrusions 20 with edge 21 of recesses 19. Since contact lamina 10 then protrudes further into plug receptacle 5 than on the initial insertion, the frictional resistance in the second insertion of contact pin 6 is increased and the opening-up peak mentioned above is not preventable. FIG. 3*b* shows the electric plug-in connector 1 in its end state with contact pin 6 completely inserted.

What is claimed is:

1. An electric plug-in connector comprising:

a plug receptacle provided for insertion of a contact pin, the plug receptacle being formed by walls of a plug-in connector housing;

a contact lamina pivotally mounted on the plug-in connector housing, a free end of the contact lamina being situated in an insertion direction of the contact pin; and a holding arm pivotally mounted on the plug-in connector housing, which protrudes at a free end into the plug receptacle in a ready-to-insert starting state of the plug-in connector and holds back the contact lamina that is prestressed into the plug receptacle, wherein at least one of the contact lamina and an the opposite housing wall is composed of an electrically conducting material for contacting the inserted contact pin.

2. The electric plug-in connector according to claim 1, wherein the contact lamina is a separate part.

3. The electric plug-in connector according to claim 1, wherein the contact lamina and the plug-in connector housing are composed of an electrically conducting material, and the contact lamina is attached to the plug-in connector housing in an electrically conducting manner.

4. The electric plug-in connector according to claim 1, wherein the contact lamina has a gold-plated contact point for electrically contacting the inserted contact pin.

5. The electric plug-in connector according to claim 1, wherein the housing wall opposite the contact lamina has a gold-plated contact point for electrically contacting the inserted contact pin.

6. The electric plug-in connector according to claim 1, wherein the holding arm has a protrusion on which the contact lamina prestressed into the plug receptacle rests in the ready-to-insert starting state of the electric plug-in connector.

7. The electric plug-in connector according to claim 1, wherein the holding arm is formed by a strap of the plug-in connector housing bent into the plug receptacle.

8. The electric plug-in connector according to claim 1, wherein the plug-in connector housing has a stop which limits a pivoting movement of the contact lamina into the plug receptacle.

9. The electric plug-in connector according to claim 8, wherein the stop is formed by an edge of a recess of the plug-in connector housing in which the contact lamina engages with a side protrusion.

* * * * *